US006651854B1

(12) United States Patent
LaCoste

(10) Patent No.: US 6,651,854 B1
(45) Date of Patent: Nov. 25, 2003

(54) CELL PHONE CARRIER APPARATUS

(76) Inventor: Marvin LaCoste, P.O. Box 292, Kiln, MS (US) 39556

( * ) Notice: Subject to any disclaimer, the term of this patent is extended or adjusted under 35 U.S.C. 154(b) by 138 days.

(21) Appl. No.: 10/066,973

(22) Filed: Oct. 22, 2001

(51) Int. Cl.[7] ..... A45F 3/00

(52) U.S. Cl. ..... 224/196; 224/199; 224/236; 224/240; 224/249; 224/673; 224/677; 224/680; 224/930

(58) Field of Search ..... 224/196, 199, 224/236, 240, 249, 671, 673, 677, 680, 682, 684, 930

(56) References Cited

U.S. PATENT DOCUMENTS 1,344,377 A * 6/1920 Brothers ..... 224/682
1,781,816 A * 11/1930 Jovino ..... 224/223
4,044,932 A * 8/1977 Harris, Jr. ..... 224/673
4,047,650 A * 9/1977 Domingos ..... 224/236
4,852,783 A * 8/1989 Bryden et al. ..... 224/684
5,511,704 A * 4/1996 Linderer ..... 224/240
5,718,192 A * 2/1998 Sebastian ..... 224/240
5,957,357 A * 9/1999 Kallman ..... 224/930
6,050,464 A * 4/2000 Ramsey, Sr. et al. ..... 224/196
6,182,878 B1 * 2/2001 Racca ..... 224/930
6,478,205 B1 * 11/2002 Fujihashi ..... 224/236

* cited by examiner

*Primary Examiner*—Gary E. Elkins
(74) *Attorney, Agent, or Firm*—Gregory C. Smith; Garvey, Smith, Nehrbass & Doody, L.L.C.

(57) ABSTRACT

A cell phone carrying case which includes an elongated pocket for insertion of the cell phone thereinto, the pocket including an orifice for the antenna of the phone to protrude therethrough. There is further included an upper flap member which includes a vertical slot therein for allowing a belt loop of pants or like garment to fit therethrough, so that when a belt is passed through the loop, the flap is engaged between the belt and the pants or garment during carrying. The flap is of such a length that the carrying case portion of the carrier can be rolled up so that the phone is engaged tightly against the belt loop and belt when the flap is engaged in the closed or sealed position. There could be further included a pocket for holding a pen or the like for writing as one would be using the phone.

11 Claims, 4 Drawing Sheets

CELL PHONE CARRIER APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to cell phone carriers. More particularly, the present invention relates to a carrier for cell phones which can be mounted on a person's belt for easy access thereto.

2. General Background of the Invention

In our society today, cell phones have become a very commonplace articles for a person to carry during the course of the day. Because of the small handheld nature of cell phones, cell phones are able to fit in pockets or the like, but often times it is inconvenient when a cell phone has to be placed in a pocket which is inaccessible or a purse or the like carrier. Therefore, there is commonplace certain types of carriers for cell phones, some of which are mounted on a belt similar to a holster, or the cell phone is dangling from a hook or the like which is mounted on a person's belt for easy access to the cell phone.

However, there appears to be a need in the industry for a case which is able to accommodate a cell phone but where the cell phone is not dangling or supported by a person's belt, but is supported in a horizontal fashion along the belt line. Such a case is particularly suitable for being mounted in combination with a belt loop of a pair of pants, for example, and for allowing the phone to be mounted tightly against the belt when not in use yet allowing the phone to be easily accessible when the case is open.

BRIEF SUMMARY OF THE INVENTION

The apparatus of the present invention solves the problems in the art in a simple and straightforward manner. What is provided is a cell phone carrying case which includes an elongated pocket for insertion of the cell phone thereinto, the pocket including an orifice for the antenna of the phone to protrude therethrough. There is further included an upper flap member which includes a vertical slot therein for allowing a belt loop of pants or other type garment to fit therethrough, so that when a belt is passed through the loop, the flap is engaged between the belt and the pants during carrying. The flap is of such a length that the carrying case portion of the carrier can be rolled up so that the phone is engaged tightly against the belt loop and belt when the flap is engaged in the closed or sealed position. There could be further included a pocket for holding a pen or the like for writing as one would be using the phone.

Therefore, it is a principal object of the present invention to provide a cell phone carrying case which is supported along the belt line of a carrier, so that a person's belt when engaged through a belt loop, engages the case between the belt and the garment and maintains the case in position;

It is a further object of the present invention to provide a cell phone carrying case which allows a cell phone to be slidably engaged within a pocket and rolled up against the belt line so that a flap member may be placed in the closed position to hold the phone engaged against the belt line.

It is a further object of the present invention to provide a case which allows a cell phone to be supported at the level of the belt of a person's belt rather than dangling from the belt in a holster or the like carrier.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
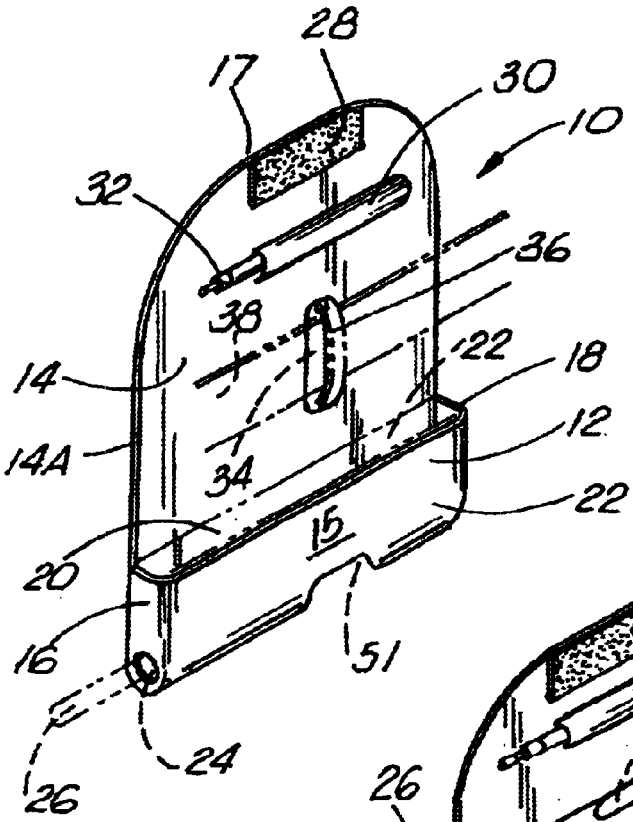
FIG. 1 illustrates an overall view of the carrier of the present invention in the open position.
Figure 2:
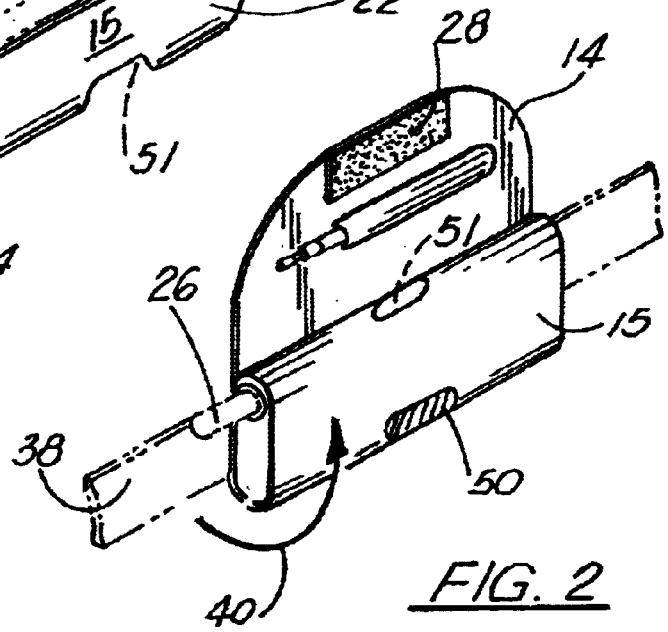
FIG. 2 illustrates an intermediate position of the phone carrier of the present invention.
Figure 3:
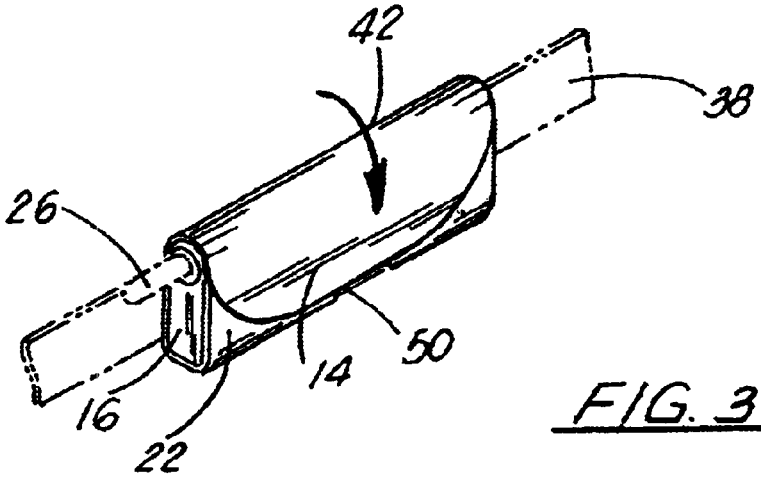
FIG. 3 illustrates the closed and engaged position of the phone case of the present invention.

Turning now first to FIGS. 1–3, there is illustrated the apparatus of the present invention by the numeral 10. Carrying case 10 would include a first cell phone carrier portion 12 and an upper flap portion 14. Carrier portion 12 includes a forward wall 15, a pair of side walls 16, 18, engaged along a rear wall 20 of the flap 14, to define a pocket 22 for engaging a cell phone therein in a substantially horizontal position, as will be discussed further. There is further illustrated an orifice 24 which would be provided along a lower portion of a side wall, for example 16, wherein an antenna 26 of a cell phone (not completely illustrated) would protrude therethrough when the cell phone is placed within pocket 22. There is further included an opening 51 along the bottom of wall 15.

As illustrated further in FIG. 1, flap member 14 has an elongated side wall 14A, which terminates in an upper rounded end portion 17. The inner face of flap 14 includes a Velcro or the like patch 28 which would engage the flap in the closed position as would be discussed further. Further, there is illustrated a second pocket 30 formed along the face of the flap 14 which would hold a pen 32 or the like, as illustrated in FIG. 1, so that one would have access to the pen during use of the phone.

An important feature of the present invention is the fact that the flap member includes an elongated opening 34 along its face, wherein a belt loop 36 or the like, would extend through the opening, so that when the flap is placed against a garment, such as a pair of pants, the belt loop 36 would extend through the opening and a belt seen in phantom view as 38, would pass through the loop 36. Therefore, the apparatus 10 would be engaged between the belt 38 and the garment, for example, pants, to be supported against the wearer as seen in, for example, in FIG. 3.

In FIG. 1, a cell phone or the like has been placed within the pocket 22 as seen by the antenna 26 protruding through opening 24. Once the cell phone is in the pocket 22, the pocket 22 is then rotated in the direction of arrow 40 and the front face 13 of the pocket 22 would be pressed against the belt loop 36, with the phone having been rotated 180 degrees the position of the antenna 26 in FIG. 2. In this position, the phone is held within the pocket 22 against the belt 38 ready for storage. Once it is in this position, reference is made to FIG. 3 where the upper portion of the flap 14 is brought to the down position, in the direction of arrow 42, where the Velcro member 28 seals against a second Velcro member 50 on pocket 22, so that the phone is in the storage position, as seen in FIG. 3, pressed tightly against belt 38.

Figure 4:
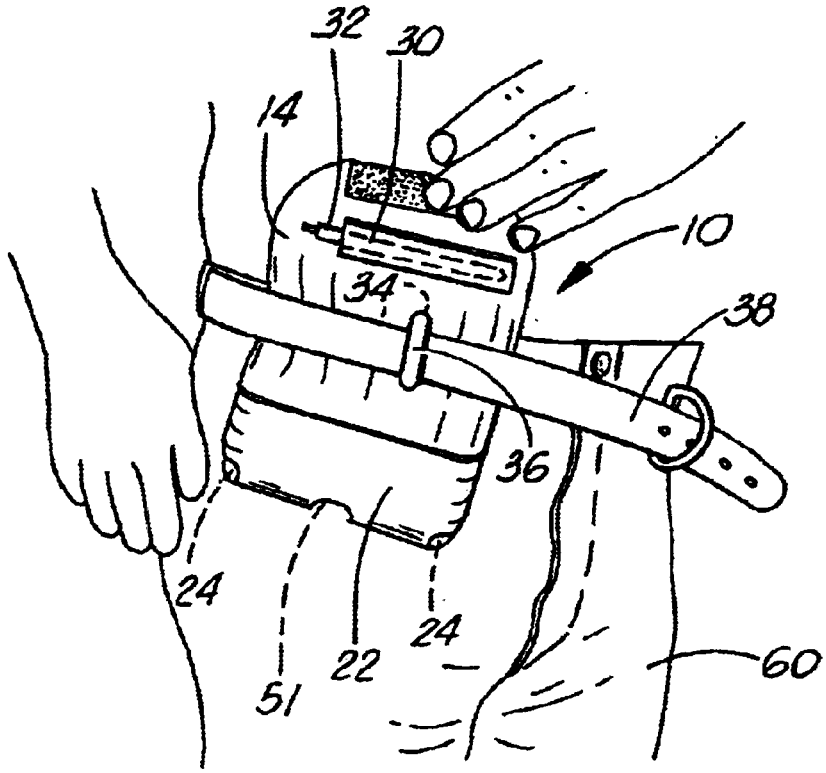
Figure 5:
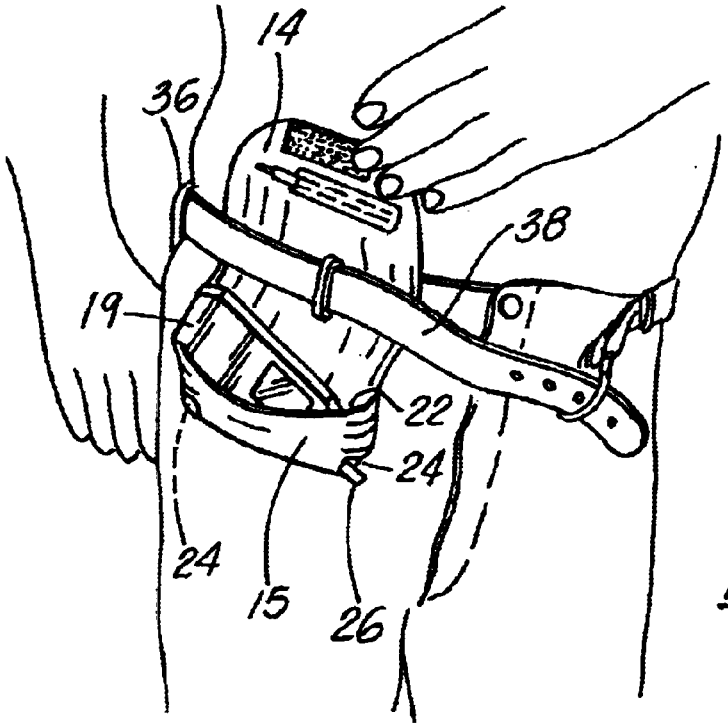
FIGS. 5–8 illustrate sequential views of the cell phone carrier of the present invention as it is moving from the completely open and empty position to the completely closed and locked position engaging a cell phone therein.
Figure 6:
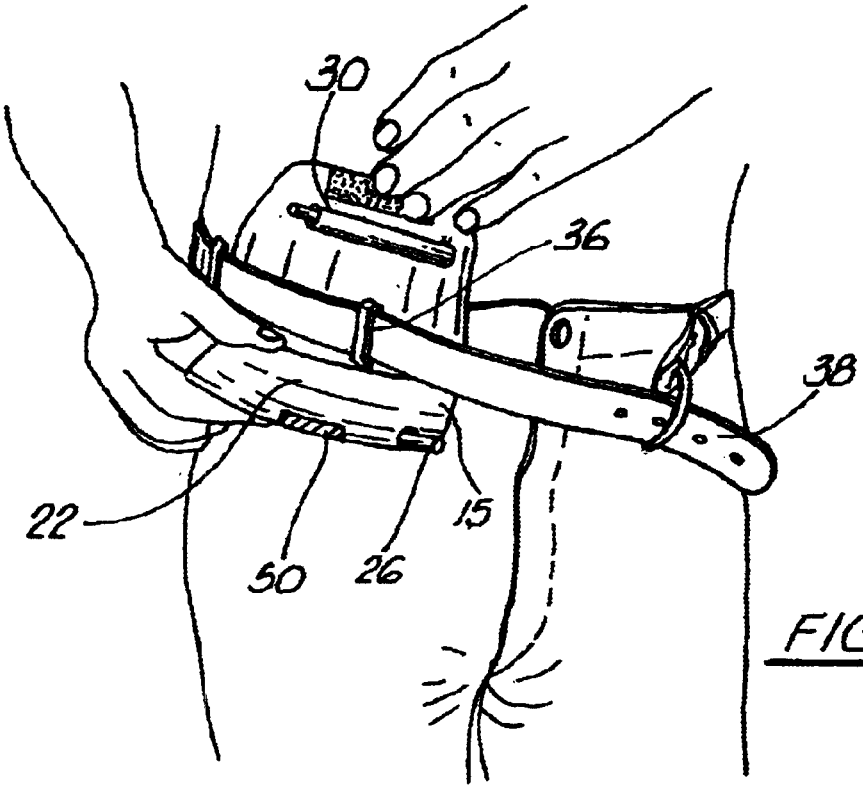
Figure 7:
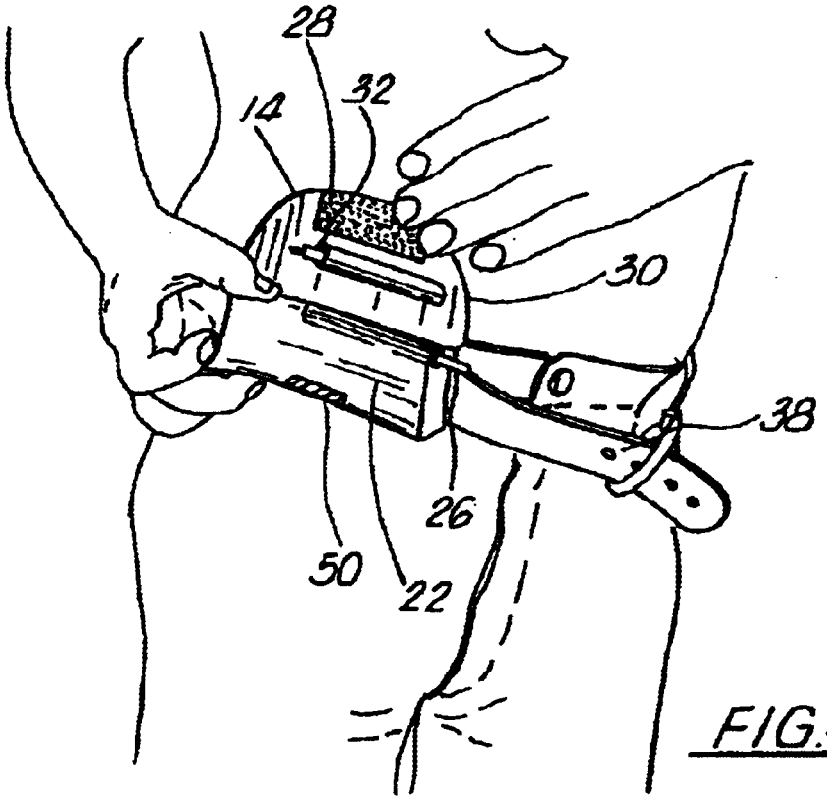
Figure 8:
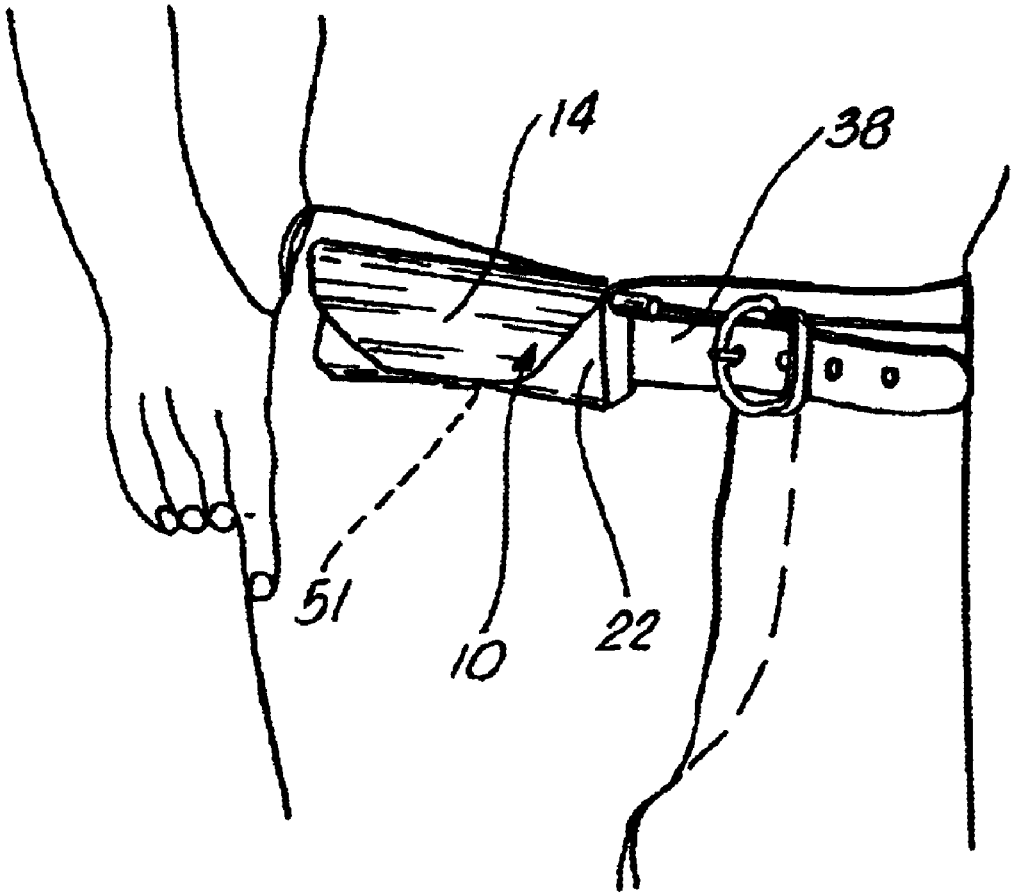

Turning now to FIGS. 4–8, these figures illustrate in sequential view the positioning and the operation of the apparatus 10 in use. As seen in FIG. 4, the apparatus 10 is basically configured in the same manner as was discussed in relation to FIG. 3, except that there is no cell phone contained within the pocket 22. However, a belt loop 36 has been positioned through opening 34 in the flap 14, and the belt 38 has been threaded through loop 36 so that the apparatus 10 is held against the pair of pants 60 by the belt being engaged through loop 36. Next, reference is made to FIG. 4 where a cell phone 19 has been slid into the pocket 22 and the antenna 26 is protruding through the opening 24. For purposes of clarity, there could be an opening 24 on each corner of the pouch 14 so as to allow the cell phone 19 to be engaged in either direction. Once this is accomplished, reference is made to FIG. 6 where once the phone is in position, the pocket 22 is then rotated, as was seen in FIG. 2, to a position as seen in FIG. 7, where the cell phone 19 has now been rotated 180 degrees and is pressing against the belt 38 as seen in FIG. 7. At this point, the phone is firmly engaged within the pocket 22 and the next step is to allow the upper portion of the flap 14 to be brought down. The Velcro would then be mated against one another so as to provide the apparatus 10 as seen in FIG. 8 in the closed position against belt 38. Therefore, the cell phone 19 is carried at belt level, is well secured within the pocket 22. When one wishes to use the phone 19, one would simply release the upper portion of the flap 14 from the Velcro connection and the phone 19 would rotate down 180 degrees to the position as seen in FIG. 1, so as to have easy access thereto and easy access to pen 32 held within holder 30.

This invention would also include the method for carrying the cell phone 19 and the cell phone carrier 10 by a wearer which would be accomplished by providing the pocket 22 containing the cell phone 19; providing the flap 14 extending upward from the pocket 22; engaging a belt loop 36 of a garment through the opening in the flap 14; passing the belt 38 through the belt loop 36 to engage the flap 14 against the garment and the belt 38 while the pocket 22 is positioned in a first position below the belt loop 36; then rotating the pocket 22 containing the cell phone 19 180 degrees to a second position so that the pocket 22 resides at a level against the belt 38; and then engaging the flap 14 against an outer face of the pocket 22 to secure the pocket 22 at the level of belt 38 in a closed and stored position. Therefore, when the flap 14 is disengaged from the pocket 22, when the pocket 22 is in the second position, the pocket 22 returns to the first position for accessing the cell phone 19.

The foregoing embodiments are presented by way of example only; the scope of the present invention is to be limited only by the following claims.

What is claimed is:

1. An apparatus for carrying cell phones, comprising:

a. a pocket portion for inserting the cell phone thereinto;

b. a flap member extending upward from the pocket portion;

c. an opening formed in a wall of the flap member for accommodating a belt loop therethrough, so that a belt can be threaded through the loop;

d. the flap member allowing the pocket portion to be rotated upward to rest against the belt, while an upper portion of the flap member folds downward against the pocket portion to define the apparatus in a closed position against the belt.

2. The apparatus in claim 1, wherein there is further provided at least one orifice in a wall of the pocket portion for allowing an antenna of the cell phone to protrude therethrough.

3. The apparatus in claim 1, wherein the flap is held closed against the pocket portion with velcro material.

4. The apparatus in claim 1, wherein there is further provided a pouch along an inner wall of the flap member for slidably engaging a writing instrument therein.

5. The apparatus in claim 1, wherein in a first open position, the pocket portion is positioned below the belt of the wearer, and in the close position, the pocket portion is rotated to a position level with the belt of the wearer.

6. An apparatus for carrying cell phones, comprising:

a. a pocket portion for inserting the cell phone thereinto;

b. a flap member extending upward from the pocket portion;

c. an opening formed in a wall of the flap for accommodating a belt loop therethrough, so that a belt can be threaded through the loop;

d. in a first open position, the pocket portion dangling below the level of the belt, and in a second closed position, the pocket rotated upward to rest against the belt; and e. means for sealing the flap against the pocket when the pocket has been rotated to the second closed position.

7. The apparatus in claim 6, wherein there is further provided at least one orifice in a wall of the pocket portion for allowing an antenna of the cell phone to protrude therethrough.

8. The apparatus in claim 6, wherein the flap is held closed against the pocket portion with velcro material.

9. The apparatus in claim 6, wherein there is further provided a pouch along an inner wall of the flap member for slidably engaging a writing instrument therein.

10. A method of carrying a cell phone in a cell phone carrier by a wearer, comprising the following steps:

a. providing a pocket containing a cell phone;

b. providing a flap extending upward from the pocket;

c. engaging a belt loop of a garment through an opening in the flap;

d. passing a belt through the belt loop to engage the flap between the garment and the belt while the pocket is positioned in a first position below the belt loop;

e. rotating the pocket containing the cell phone 180 degrees to a second position so that the pocket resides at a level against the belt;

f. engaging the flap against an outer face of the pocket to secure the pocket at the level of the belt in a closed and stored position.

11. The method in claim 10, wherein when the flap is disengaged from the pocket when the pocket is in the second position, the pocket returns to the first position for accessing the cell phone.

* * * * *